US005350888A

United States Patent [19]

Sager, Jr. et al.

[11] Patent Number: 5,350,888

[45] Date of Patent: Sep. 27, 1994

[54] BROAD BAND LOW FREQUENCY PASSIVE MUFFLER

[75] Inventors: Robert L. Sager, Jr., Grass Lake; Leon A. Kraai, Jackson, both of Mich.

[73] Assignee: Tennessee Gas Pipeline Company, Lincolnshire, Ill.

[21] Appl. No.: 168,574

[22] Filed: Dec. 16, 1993

Related U.S. Application Data

[63] Continuation of Ser. No. 877,458, May 1, 1992, abandoned.

[51] Int. Cl.[5] ..... F01N 1/00; F01N 1/10

[52] U.S. Cl. ..... 181/247; 181/252; 181/256; 181/267

[58] Field of Search ..... 181/247, 252, 256, 267

[56] References Cited

U.S. PATENT DOCUMENTS

| | | | |
|---|---|---|---|
| 1,878,424 | 9/1932 | Oldberg | 181/250 |
| 1,975,861 | 10/1934 | Oldberg | 181/250 |
| 2,014,666 | 9/1935 | Peik | 181/252 |
| 2,066,467 | 1/1937 | Gray | 181/247 |
| 2,099,858 | 11/1937 | MacKenzie et al. | 181/250 |
| 2,311,676 | 2/1943 | Maxim | 181/252 |
| 2,326,612 | 8/1943 | Bourne | 181/252 |
| 2,583,366 | 1/1952 | Engels | 181/252 |
| 2,834,425 | 5/1958 | Rawson | 181/252 |
| 2,855,068 | 10/1958 | Chapel | 181/252 |
| 2,937,707 | 5/1960 | Ernst | 181/252 |
| 2,940,538 | 6/1960 | Billey | 181/249 |
| 3,754,619 | 8/1973 | McCormick | 181/248 |
| 3,981,378 | 9/1976 | Potter | 181/230 |
| 4,263,981 | 4/1981 | Weiss et al. | 181/252 |
| 4,371,053 | 2/1983 | Jones | 181/249 |
| 4,444,288 | 4/1984 | Sekiya et al. | 181/258 |

OTHER PUBLICATIONS

*Noise and Vibration Control*—pp. 365–371; author L. L. Beranek ed., revised edition no date.

*Primary Examiner*—Michael L. Gellner
*Assistant Examiner*—Eddie C. Lee
*Attorney, Agent, or Firm*—Harness, Dickey & Pierce

[57] ABSTRACT

A sound absorbing muffler used to attenuate noise carried by the exhaust gases of an internal combustion engine includes a straight-through flow tube of cross-section having no baffles or flow reversals. The muffler utilizes both reactive and dissipative components and includes an outer annular resonating chamber and an inner sound absorbing chamber. The muffler's configuration produces effective broad band noise attenuation even at lower frequencies, yet low backpressure.

18 Claims, 3 Drawing Sheets

BROAD BAND LOW FREQUENCY PASSIVE MUFFLER

This is a continuation of U.S. patent application Ser. No. 07/877,458, filed May 1, 1992, now abandoned.

BACKGROUND OF THE INVENTION

1. Field of the Invention

This invention relates to a sound attenuating muffler, and more particularly to a muffler for damping sound waves of specific frequencies.

2. Discussion

Mufflers are generally incorporated in automobile exhaust systems to limit the sound pressure level of exhaust noise produced by engine operation. There are two general classifications of mufflers, reactive and dissipative. Reactive mufflers are generally composed of a number of resonating chambers of different volumes and shapes connected with pipes. Reactive mufflers may include baffles or flow reversals. However, these configurations produce a relatively high pressure drop, causing a backpressure at the exhaust of the engine, thus restricting engine performance. Dissipative mufflers are usually composed of ducts or chambers which are filled with acoustic absorbing materials such as fiberglass, steel wool, or a porous ceramic. These materials absorb the acoustic energy and transform it into thermal energy. Unfortunately, the sound absorbing material in dissipative mufflers tend to break down because of the velocity of the material and the high velocity and temperature of the exhaust. Mufflers consisting of a combination of the reactive and dissipative types are known in the art in a variety of configurations.

The prior art muffler systems generally fail to attenuate sound waves over a broad band of frequencies. Mufflers typically provide effective attenuation only at specified frequencies equal to or greater than a specific cut-off frequency. The transmission loss, or effectiveness under ideal conditions, of a typical dissipative muffler is generally an inclined straight line with respect to frequency, and provides effective attenuation only above approximately 500 Hertz. As a result, the typical dissipative muffler fails to attenuate low frequency sound. This failure is unacceptable in an automobile exhaust muffler because the sound produced by the engine has greatest amplitude at lower frequencies, such as below approximately 500 Hertz. The transmission loss of a typical reactive muffler or expansion can is generally a periodic series of sinusoidal "humps." As a result, a reactive muffler provides acceptable amplitude levels of low frequency attenuation, but exhibits a series of "zero frequencies" where the muffler provides no attenuation. It is desirable to combine the accoustic performance of both types of mufflers to achieve broad band low frequency attenuation in a low back pressure muffler.

SUMMARY OF THE INVENTION

The present invention provides a sound attenuating muffler for the exhaust gas of an internal combustion engine including a housing, an elongated straight-through flow tube with constant cross section and having no baffles or flow reversals, an annular inner dissipative sound absorbing chamber, and an outer reactive resonating chamber in surrounding relationship. The flow tube has perforations which allow fluid communication between the flow tube and the annular dissipative chamber, and the muffler has apertures which allow fluid communication between the dissipative chamber and the resonating chamber. The muffler of the present invention has a configuration which provides broad band attenuation of sound, even at low frequencies.

It is an object of the present invention to provide a muffler capable of effectively attenuating noise over a broad band of frequencies, including lower frequencies.

This and other advantages and features will become apparent from the following description and claims in conjunction with the accompanying drawings.

DETAILED DESCRIPTION OF THE PREFERRED EMBODIMENT

The following description of the preferred embodiment is merely exemplary and is in no way intended to limit the invention or its application or uses.

Figure 1:
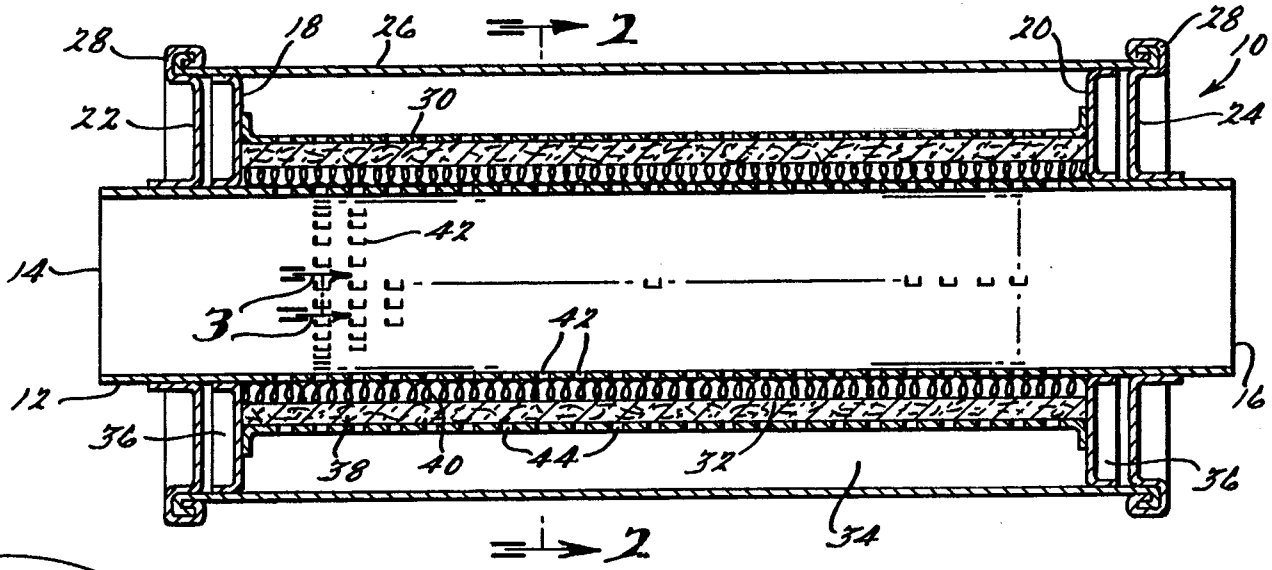
FIG. 1 is a sectional view of a muffler arranged according to the principles of the present invention.
Figure 2:
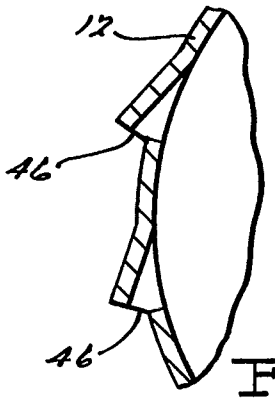
FIG. 2 is a sectional view along line 2—2 in FIG. 1.

Referring to the drawings, FIG. 1 shows a muffler 10 which is connected to an exhaust pipe of an internal combustion engine by a coupling means (not shown). The exhaust fluid, normally air and other exhaust gases, flowing through the exhaust pipe carries sound waves generated during operation of the engine. The majority of the sound waves are considered undesirable noise which is to be muffled.

FIG. 1 shows a muffler 10 having a straight-through flow tube 12 which has an inlet 14 and an outlet 16. Two end plates 18,20 are mounted to the flow tube 12, and comprise disks with no perforations other than the one allowing assembly on the flow tube 12. Two outer support members 22,24 are affixed to flow tube 12 outside of the end plates 18,20. An outer shell 26 is mounted about the flow tube 12, affixed to the perimeter of the end plates 18,20 and the support members 22,24. The edges of the support members 22,24 and the outer shell 26 are curled to form an end roll 28 to provide a seal. The outer shell 26 thus spans the space between the end plates 18,20. Outer shell 26 is imperforate, allowing no gas or sound waves to escape. An inner shell 30 is affixed to and spans the distance between the end plates 18,20. The inner shell 30 is located intermediate between the flow tube 12 and the outer shell 26. The end plates 18.20, flow tube 12, and inner shell 30 define an annular inner sound absorbing chamber 32. The end plates 18,20, inner shell 30 and outer shell 26 define an outer annular resonating chamber 34. The end plates 18,20, outer shell 26 and outer support members 22,24 define empty chambers 36 which exist for structural purposes only and have substantially no acoustic effect. The construction material for the flow tube 12, end plates 18,20, outer shell 26, and inner shell 30 is preferably a metal, such as stainless steel or aluminized coated or low carbon steel.

The inner sound absorbing dissipative chamber 32 contains sound absorbing material 38. This material is preferably fiberglass, and may also be wire mesh or steel wool. A thin wire screen 40 may preferably be wrapped immediately around the flow tube 12 extending the length of the muffler 10. The sound absorbing chamber 32 operates to reduce pressure pulsations flowing from inside the flow tube 12 into the annular chambers 32,34. This annular sound absorbing means 32 acts as a mechanical filter to dampen high pressure spikes.

Figure 3:
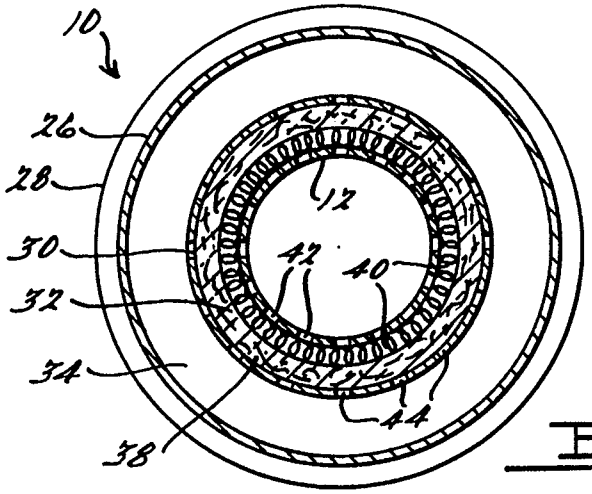
FIG. 3 is an enlarged partial sectional view of one aspect of the present invention.

The flow tube 12 is preferably a straight round cylinder passing entirely through the muffler 10 and having a constant diameter and cross-section. The flow tube 12 has a smooth and continuous interior surface, with no baffles or flow barriers, and is formed with perforations 42 around its perimeter to allow the sound waves to communicate with the sound absorbing chamber 32. The dimension of these perforations 42 is preferably on the order of 0.120 inches, and the flow tube 12 preferably has an open area ratio of the surface area of the perforations to the surface area of the cylinder defined by flow tube 12 of approximately 40% to 70%. In addition, the inner shell 30 is formed with apertures 44 comprising holes allowing fluid communication therethrough. The dimension of these apertures 44 is preferably on the order of 0.250 inches, and the inner shell 30 preferably has an open area ratio of approximately 30% to 40%. In the preferred embodiment, these apertures 42,44 are formed as louvers 46, rather than through holes, as shown in FIG. 3. Louvers 46 may be formed in various configurations, and the louvers 46 shown in FIG. 3 serve only as an example.

The cross-section of the muffler 10 is preferably an oval shape, but may also be round, or even square or rectangular. An oval muffler 10 produces better noise attenuation and causes little shell ringing. A square or rectangular muffler 10 may transmit high frequency sound and resonate.

The transmission loss of a muffler is a measure of its effectiveness. It represents the noise attenuating capability of the muffler if it were placed in the ideal location in the muffler system.

Figure 4:
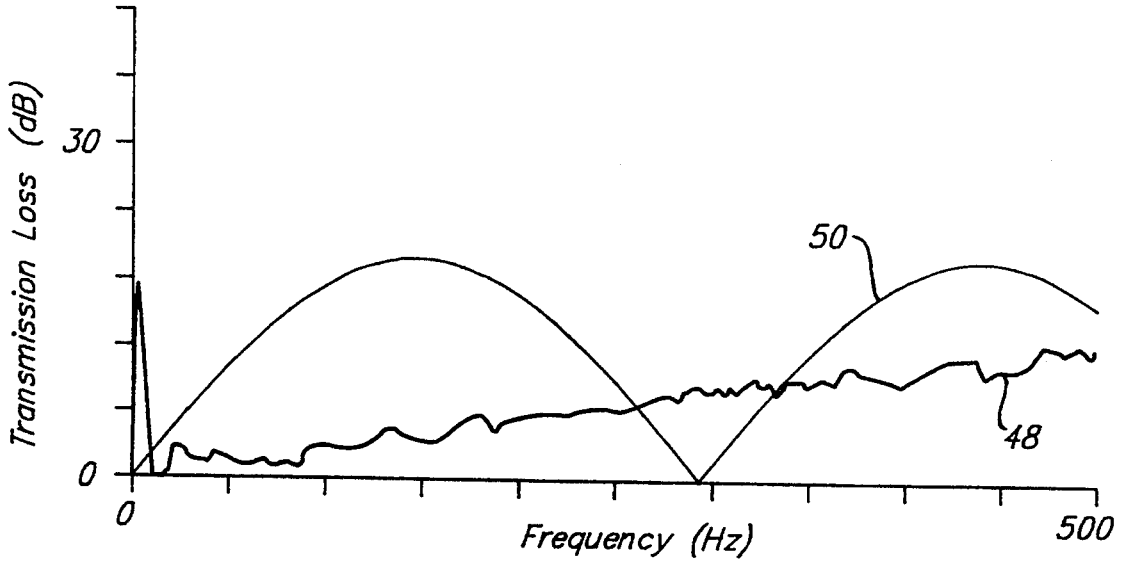
FIG. 4 is a graph showing transmission loss for a typical dissipative and reactive muffler.

A typical dissipative muffler is simply a muffling chamber filled with sound absorbing material, usually having a different cross-sectional area than the inlet and outlet tubes. FIG. 4 shows a graph of measured transmission loss 48 for a typical dissipative muffler. The response is generally an inclined straight line with respect to frequency, except for a boundary value anomaly near zero Hertz. This muffler attenuates less than 12 decibels up to 500 Hertz, where most exhaust noise is produced.

A typical reactive muffler or expansion can consists of an enclosed muffling chamber having a larger cross-section than the inlet and outlet. FIG. 4 shows a theoretical transmission loss curve 50 for a typical expansion can. The response with respect to frequency is generally a periodic series of "humps" having a series of zero points where the muffler provides no attenuation. These zero points constitute a failure of the muffler for the various frequencies.

Figure 5:
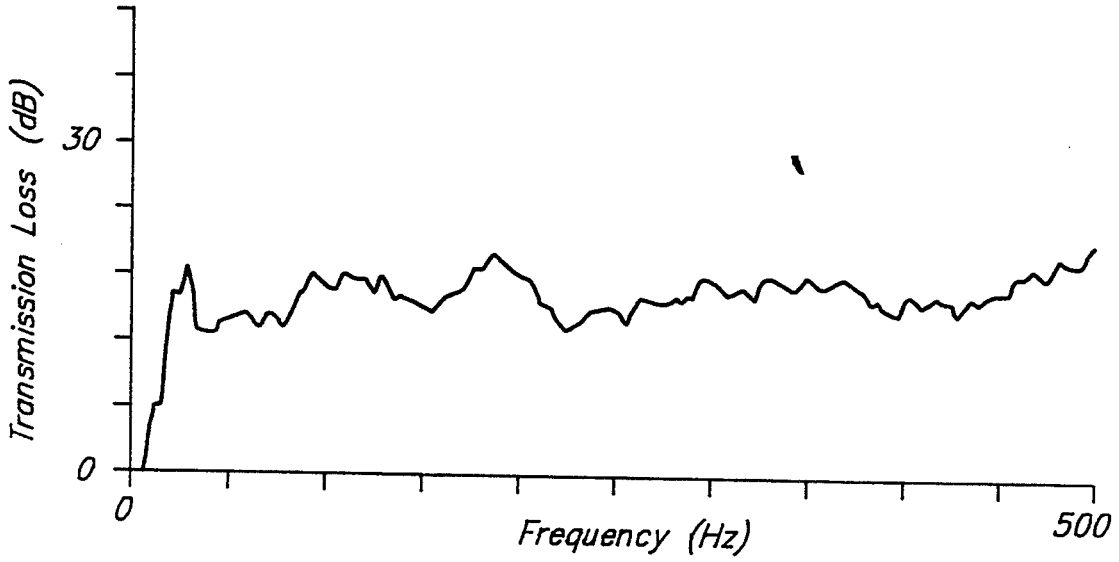
FIGS. 5 and 6 are graphs showing transmission loss for a muffler arranged according to the present invention.
Figure 6:
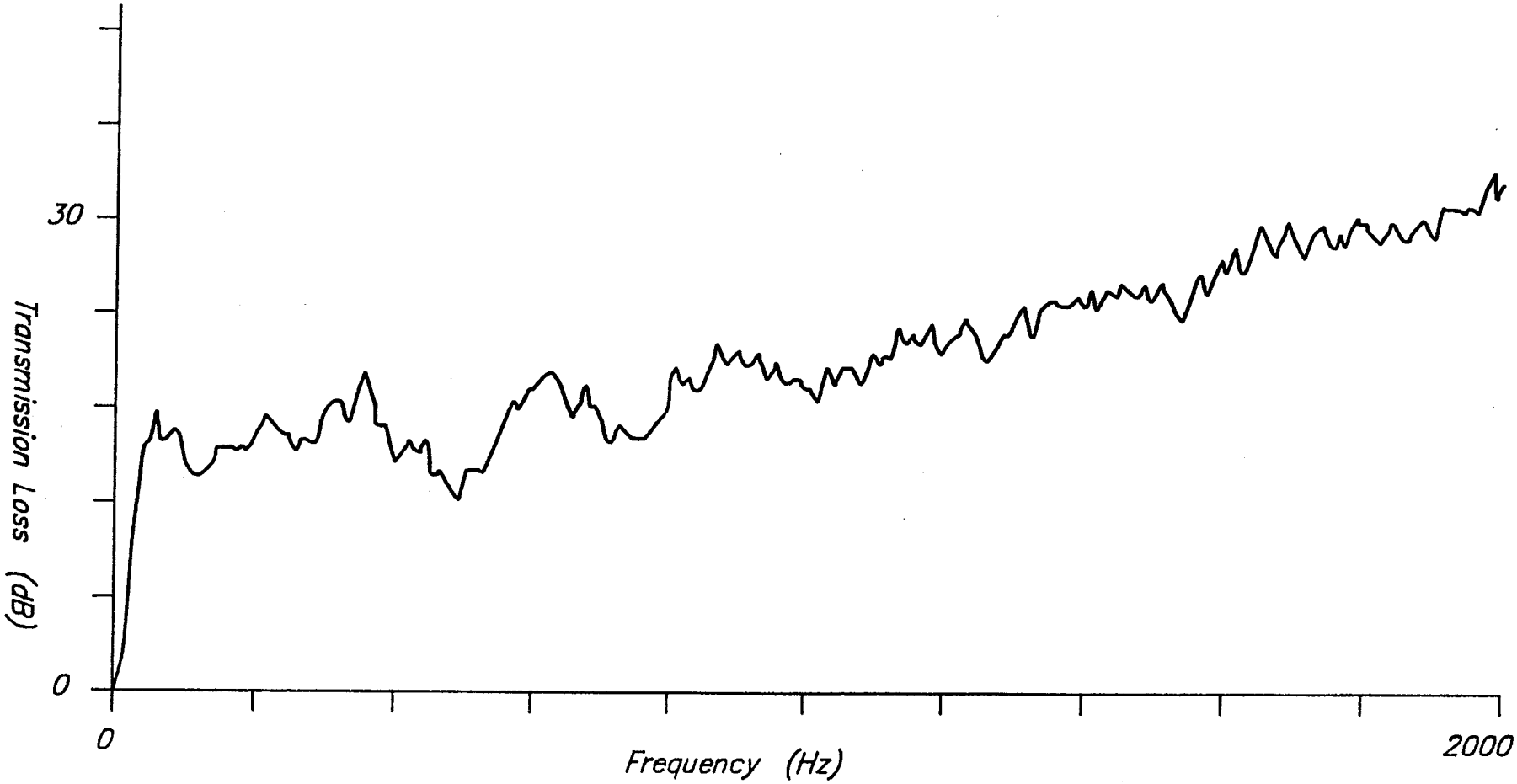

FIG. 5 shows transmission loss for a muffler 10 arranged according to the present invention as disclosed in the Example below. The response illustrates broad band attenuation below 500 Hertz of 12 to 20 decibels. The muffler 10 thus produces high attenuation at the highest level of performance provided by an expansion can, yet without any zero points. FIG. 6 depicts transmission loss for the same configuration across a broader range of frequencies and shows that attenuation continues to increase even after 500 Hertz, as would a dissipative muffler. This high frequency performance attenuates any harmonics produced by the mostly low frequency exhaust noise. As a result, the muffler produces at least approximately 12 decibels of attenuation at all relevant frequencies.

In an alternative embodiment of the present invention, the flow tube 12 is not axially aligned with the centroid of the muffling chamber defined by the outer shell. This off-center configuration enables the present invention to fit within the volume available in the particular application, usually the undercarriage of an automobile.

All embodiments of the present invention may be tuned to eliminate specific ranges of noise frequencies by altering the various dimensions of the muffler, including flow tube, inner shell, and outer shell diameters, and muffler length. The ratio of the volume of the inner shell or dissipating chamber to the volume of the resonating chamber may also be set to tune the muffler. Depending on the desired noise frequencies for attenuation, the volume ratio may range from approximately 20% to 80%.

All embodiments of the present invention operate in substantially the same manner. In operation, exhaust gas enters the inlet 14 to the flow tube 12 of the muffler 10, and may flow straight though the flow tube 12 and exit from the outlet 16. High pressure pulses of exhaust gas may flow from the flow tube 12 though its apertures 42, through the wire screen 40 wrapped around the flow tube 12, through the sound-absorbing material 38 contained in annular inner shell 30, through the perforations 44 in the inner shell 26 and into the resonating chamber 34. High pressure pulses are damped by the sound-absorbing chamber 32, as well as by the finite volume enclosed by the outer shell 26 and end plates 14,16 of the muffler 10. Exhaust gas tends to flow straight through the flow tube 12 and not to escape through the perforations 42 on the flow tube 12, because the gas cannot escape the muffler 10 by any other means than the outlet 16.

Acoustic noise carried by exhaust gas is attenuated by absorption and reflection. The sound-absorbing material 38 contained in inner shell 30 operates to absorb the sound waves by transforming mechanical acoustic energy into thermal energy. The resonating chamber 34 operates to reflect specific frequencies of sound through the flow tube 12, back out the inlet 14 of the muffler 10.

EXAMPLE

A muffler 10 was constructed having a configuration according to the present invention. The inlet 14 and outlet 16 were formed having an inside diameter of 2.0 inches. The flow tube 12 had an outside diameter of 2.25 inches. The length of the sound absorbing 32 and resonating chambers 34 was 24.0 inches. The wrap of stainless steel wool 40 around the flow tube had a bias weight of 900 grams/square meter and a thickness of 0.25 inches. The (E glass) sound absorbing material 38 had a density of 1.0 pounds/cubic foot and a thickness of 1.5 inches. The resonating chamber 34 or air gap was 1.0 inch thick. The sound absorbing chamber 32 was therefore 1.75 inches thick and the outer shell 26 diameter was $7\frac{3}{4}$ inches. The transmission loss for the muffler having the above dimensions is shown in FIGS. 5 and 6.

It should be understood that various modifications of the preferred embodiments of the present invention will become apparent to those skilled in the art after a study of the specification, drawings, and the following claims.

We claim:

1. An acoustic muffler for attenuating sound waves, comprising:

an elongated, continuous, straight through tubular member;

an annular sound absorbing chamber surrounding said tubular member, said sound absorbing chamber containing sound absorbing material;

an annular resonating chamber surrounding said sound absorbing chamber, said sound absorbing chamber and said resonating chamber being of substantially equal length and defining a first and second end, said tubular member transversing said length of said chambers;

a first and second imperforate annular end chamber, each surrounding said tubular member and each being disposed adjacent to one of said first and second ends of said sound absorbing and resonating chambers respectively, said tubular member extending continuously from a first outer end of said first end chamber to a second outer end of said second end chamber;

a plurality of apertures formed on said tubular member allowing fluid communication between the volume within said tubular member and said sound absorbing chamber; and a plurality of apertures allowing fluid communication between said sound absorbing chamber and said resonating chamber.

2. The muffler as set forth in claim 1, wherein said apertures formed on said tubular member have a width of approximately 0.120 inches.

3. The muffler as set forth in claim 1, wherein said apertures allowing fluid communication between said sound absorbing chamber and said resonating chamber have a width of approximately 0.250 inches.

4. The muffler as set forth in claim 1, wherein said apertures formed on said tubular member are arranged to provide an open area of approximately 40% to 70%.

5. The muffler as set forth in claim 1, wherein said apertures allowing fluid communication between said sound absorbing chamber and said resonating chamber are arranged to provide an open area of approximately 30% to 40%.

6. The muffler as set forth in claim 1, wherein said apertures are formed as louvers.

7. The muffler as set forth in claim 1, further comprising an outer shell surrounding said resonating chamber, wherein a centroid defined by said tubular member is located at a centroid defined by said outer shell.

8. The muffler as set forth in claim 1, wherein said muffler has a cylindrical cross-section.

9. The muffler as set forth in claim 1, further comprising a screen in surrounding contact with said tubular member.

10. (Thrice Amended) An acoustic muffler for attenuating sound waves, comprising:

an elongated straight through tubular member;

first and second inner end plates mounted about said tubular member and being spaced apart;

first and second outer end plates mounted about said tubular member and being disposed outside of said inner end plates, said tubular member extending continuously from said first outer end plate to said second outer end plate;

an inner shell coupled with said inner end plates and extending therebetween so as to define, in conjunction with said tubular member and said inner end plates, an annular sound absorbing chamber;

sound absorbing material being contained in said sound absorbing chamber;

an outer shell coupled with said inner end plates and extending therebetween so as to define, in conjunction with said inner shell and said inner end plates, an annular resonating chamber in surrounding relationship with said sound absorbing chamber;

a first and second annular end chamber defined by said tubular member, said inner and outer end plates and said outer shell, said end chambers being imperforate;

a plurality of apertures formed on said tubular member; and a plurality of apertures formed on said inner shell.

11. The muffler as set forth in claim 10, wherein said apertures formed on said tubular member have a width of approximately 0.120 inches.

12. The muffler as set forth in claim 10, wherein said apertures formed on said inner shell have a width of approximately 0.250 inches.

13. The muffler as set forth in claim 10, wherein said apertures formed on said tubular member are arranged to provide an open area of approximately 40% to 70%.

14. The muffler as set forth in claim 10, wherein said apertures formed on said inner shell are arranged to provide an open area of approximately 30% to 40%.

15. The muffler as set forth in claim 10, wherein said apertures are formed as louvers.

16. The muffler as set forth in claim 10, wherein a centroid defined by said tubular member is located at a centroid defined by said outer shell.

17. The muffler as set forth in claim 10, wherein said muffler has a cylindrical cross-section.

18. The muffler as set forth in claim 10, further comprising a screen in surrounding contact with said tubular member.

* * * * *